US011382390B2

(12) United States Patent
Chiou et al.

(10) Patent No.: US 11,382,390 B2
(45) Date of Patent: Jul. 12, 2022

(54) ZONAL DYNAMIC LACING SYSTEM

(71) Applicant: NIKE, Inc., Beaverton, OR (US)

(72) Inventors: George Chiou, Beaverton, OR (US); Ross Klein, Portland, OR (US); Tate E. Kuerbis, Portland, OR (US); Max Liu, Taichung (TW); Austin J. Orand, Portland, OR (US); Nuryani K. Sulistyo, Taichung (TW); Harry Y. Sun, Rowland Heights, CA (US)

(73) Assignee: NIKE, Inc., Beaverton, OR (US)

( * ) Notice: Subject to any disclaimer, the term of this patent is extended or adjusted under 35 U.S.C. 154(b) by 165 days.

(21) Appl. No.: 16/574,713

(22) Filed: Sep. 18, 2019

(65) Prior Publication Data

US 2020/0085144 A1 Mar. 19, 2020

Related U.S. Application Data

(60) Provisional application No. 62/733,411, filed on Sep. 19, 2018.

(51) Int. Cl.

| | |
|---|---|
| ***A43C 1/00*** | (2006.01) |
| ***A43C 1/06*** | (2006.01) |
| ***A43C 7/08*** | (2006.01) |

(52) U.S. Cl.

CPC ..... *A43C 1/003* (2013.01); *A43C 1/06* (2013.01); *A43C 7/08* (2013.01)

(58) Field of Classification Search

CPC .. A43C 1/003; A43C 7/00; A43C 7/08; A43C 11/16; A43C 11/165

See application file for complete search history.

(56) References Cited

U.S. PATENT DOCUMENTS 5,084,987 A * 2/1992 Flemming ..... A43B 1/0009 36/28
5,791,068 A * 8/1998 Bernier ..... A43B 1/0072 36/50.1

(Continued)

FOREIGN PATENT DOCUMENTS

| | | | |
|---|---|---|---|
| CN | 1579278 | A | 2/2005 |
| CN | 105188452 | A | 12/2015 |
| CN | 107637913 | A | 1/2018 |

OTHER PUBLICATIONS

European Patent Office, International Search Report and Written Opinion dated Jan. 3, 2020 for application No. PCT/US2019/051693.

(Continued)

*Primary Examiner* — Ted Kavanaugh
(74) *Attorney, Agent, or Firm* — Honigman LLP; Matthew H. Szalach; Jonathan O'Brien

(57) ABSTRACT

An article of footwear includes an upper and a sole structure attached to the upper. The article of footwear also includes a cable lock disposed within the sole structure adjacent to a bottom surface of the sole structure. The article of footwear includes a first cable having a first section extending from the cable lock to a first anchor point on the upper and a second section extending from the cable lock to a second anchor point on the upper. The article of footwear further includes a second cable having a first section extending from the cable lock to a grip and a second section extending from the cable lock to the grip, whereby the cable lock is operable to retract the first section and the second section of the first cable when the first section and the second section of the second cable are extended.

24 Claims, 8 Drawing Sheets

(56) References Cited

U.S. PATENT DOCUMENTS

| | | | | |
|---|---|---|---|---|
| 7,721,468 | B1 * | 5/2010 | Johnson | A43C 11/008 36/50.1 |
| 2006/0000116 | A1 | 1/2006 | Brewer | |
| 2012/0291242 | A1 * | 11/2012 | Donnadieu | A43B 5/0411 24/712.7 |
| 2015/0257489 | A1 * | 9/2015 | Trudel | A43C 11/20 24/68 SK |
| 2015/0359296 | A1 | 12/2015 | Gulla | |
| 2018/0020767 | A1 * | 1/2018 | Dyer | A43B 3/26 36/97 |
| 2019/0021447 | A1 * | 1/2019 | Whewell | A43B 23/0235 |

OTHER PUBLICATIONS

China National Intellectual Property Administration, Office Action dated Dec. 28, 2021 for application No. 201980068933.5.

* cited by examiner

ZONAL DYNAMIC LACING SYSTEM

CROSS REFERENCE TO RELATED APPLICATIONS

This non-provisional U.S. Patent Application claims priority under 35 U.S.C. § 119(e) to U.S. Provisional Patent Application Ser. No. 62/733,411, filed Sep. 19, 2018, the disclosure of which is hereby incorporated by reference in its entirety.

FIELD

The present disclosure relates generally to articles of footwear having a dynamic lacing system for moving footwear between a tightened state and a loosened state.

BACKGROUND

This section provides background information related to the present disclosure which is not necessarily prior art.

Articles of footwear conventionally include an upper and a sole structure. The upper may be formed from any suitable material(s) to receive, secure and support a foot on the sole structure. A bottom portion of the upper, proximate to a bottom surface of the foot, attaches to the sole structure. Sole structures generally include a layered arrangement extending between an outsole providing abrasion-resistance and traction with a ground surface and a midsole disposed between the outsole and the upper for providing cushioning for the foot.

The upper may cooperate with laces, straps, or other fasteners to adjust the fit of the upper around the foot. For instance, laces may be tightened to close the upper around the foot and tied once a desired fit of the upper around the foot is attained. Care is required to ensure that the upper is not too loose or too tight around the foot each time the laces are tied. Moreover, the laces may loosen or become untied during wear of the footwear. While fasteners such as hook and loop fasteners are easier and quicker to operate than traditional laces, these fasteners have a propensity to wear out over time and require more attention to attain a desired tension when securing the upper to the foot.

Known automated tightening systems typically include a tightening mechanism, such as rotatable knob, that can be manipulated to apply tension to one or more cables that interact with the upper for closing the upper around that foot. While these automated tightening systems can incrementally increase the magnitude of tension of the one or more cables to achieve the desired fit of the upper around the foot, they require a time-consuming task of manipulating the tightening mechanism to properly tension the cables for securing the upper around the foot, and when it is desired to remove the footwear from the foot, the wearer is required to simultaneously depress a release mechanism and pull the upper away from the foot to release the tension of the cables. Furthermore, these automated tightening systems provide a constant tensioning along the lengths of the one or more cables, whereby rotation of the rotatable knob causes the entire cable to be tightened uniformly. In instances where it may be desirable to tighten a first region of the upper at a different rate than a second region of the upper, additional cables and tightening mechanisms must be incorporated and controlled separately.

Thus, known automated tightening systems lack suitable provisions for both quickly and variably adjusting the tension of the cables to close the upper around the foot and quickly releasing the tension applied to the cables so that the upper can be quickly loosened for removing the footwear from the foot. Moreover, the tightening mechanism employed by these known automated tightening systems is required to be incorporated onto an exterior of the upper so that the tightening mechanism is accessible to the wearer for adjusting the fit of the upper around the foot, thereby detracting from the general appearance and aesthetics of the footwear.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
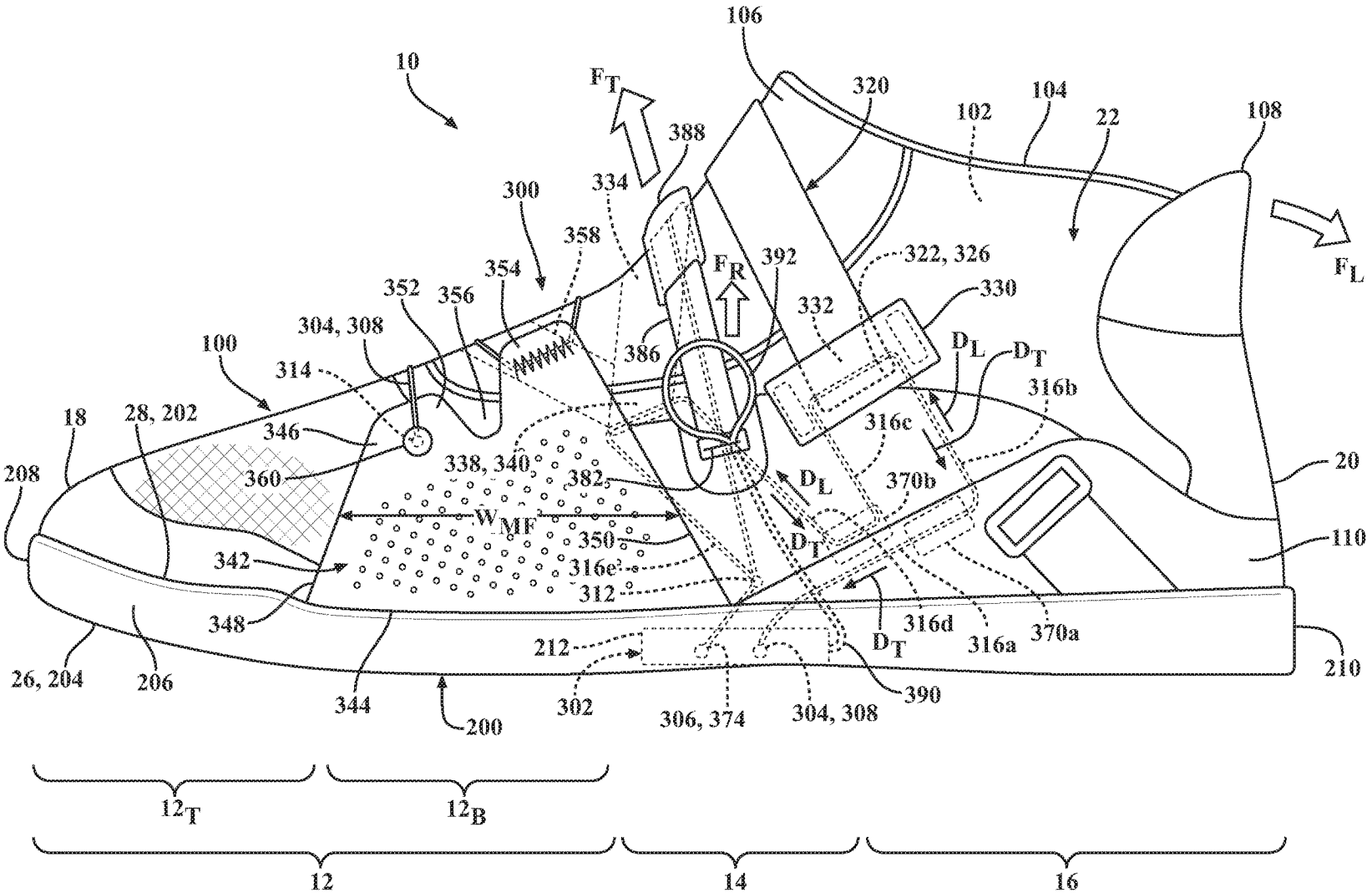
FIG. 1 is a medial side elevation view of an article of footwear having a cable lock movable between a locked state to restrict movement of a cable and an unlocked state to permit movement of the cable in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides an article of footwear. The article of footwear includes an upper defining an interior void and a sole structure attached to the upper and having a top surface facing toward the interior void and a ground-engaging bottom surface formed on an opposite side of the sole structure from the top surface. The article of footwear also includes a cable lock disposed within the sole structure adjacent to the bottom surface. The article of footwear further includes a first cable having a first section extending from the cable lock to a first anchor point on the upper and a second section extending from the cable lock to a second anchor point on the upper. The article of footwear also includes a second cable having a first section extending from the cable lock to a grip and a second section extending from the cable lock to the grip, the cable lock being operable to retract the first section and the second section of the first cable when the first section and the second section of the second cable are extended.

Implementations of the disclosure may include one or more of the following optional features. In some implementations, the cable lock is exposed to view through a viewing port disposed at the bottom surface of the sole structure. The viewing port includes an aperture extending at least partially through at least one of an outsole portion and a midsole portion of the sole structure. Here, the viewing port also includes a window comprising a transparent barrier extending across the aperture. In some examples, internal components of the cable lock are visible through the bottom surface of the sole structure.

In some configurations, the article of footwear includes a first strap extending from a first end on a medial side of the upper to a second end on a lateral side of the upper, the first end of the first strap may receive the first section of the first cable and the second end of the first strap receiving the second section of the first cable. Here, the article of footwear may also include a second strap extending from a first end at a bite line of the footwear on the lateral side to a second end on the medial side of the upper, the second end defining a loop and receiving the first section of the first cable.

In some examples, the cable lock includes a spool, the first cable being wound in a first direction around the spool and the second cable being wound in a second direction around the spool, the second direction being opposite the first direction. The first section of the first cable may include a first plurality of segments extending along a medial side of the upper to the first anchor point on the medial side of the upper, and the second section of the first cable may include a second plurality of segments extending between a lateral side of the upper and the medial side of the upper to the second anchor point on the medial side of the upper.

In some implementations, the first anchor point is disposed on a medial side of the upper in a midfoot region adjacent to a bite line of the upper and the sole structure, and the second anchor point is disposed at a distal end of a flap disposed on the medial side of the upper in a forefoot region. The flap may extend from a proximal end attached at the bite line to the distal end adjacent to an instep region of the upper. The flap may include a loop for receiving the second section of the first cable, the loop receiving a first segment and a second segment of the second section, and the second anchor point receiving a third segment of the second section.

Another aspect of the disclosure provides an article of footwear. The article of footwear includes an upper defining an interior void and a sole structure attached to the upper and having a top surface facing toward the interior void and a ground-engaging bottom surface formed on an opposite side of the sole structure from the top surface. The article of footwear also includes a cable lock disposed within the sole structure and a first cable having a first section extending in a first direction from the cable lock and a second section extending in a second direction from the cable lock, the first section including a first plurality of segments routed along a medial side of the upper through at least one strap and the second section including a second plurality of segments routed along a lateral side of the upper through the at least one strap. The article of footwear further includes a second cable extending from the cable lock and operable to move the first cable toward a retracted state when a tensile force applied to the second cable causes the second cable to pay out from the cable lock.

Implementations of the disclosure may include one or more of the following optional features. In some configurations, the cable lock is exposed to view through the bottom surface of the sole structure. The viewing port may include an aperture extending at least partially through at least one of an outsole portion and a midsole portion of the sole structure. The viewing port may also include a window comprising a transparent barrier extending across the aperture. The internal components of the cable lock may be visible through the bottom surface of the sole structure.

In some examples, the at least one strap includes a first strap extending from a first end disposed on a medial side of the upper to a second end disposed on the lateral side of the upper, the first end of the first strap receiving the first section of the first cable and the second end of the first strap receiving the second section of the first cable. Here, the at least one strap may include a second strap extending from a first end attached to the lateral side the footwear on the lateral side to a second end on the medial side of the upper, the second end defining a loop and a receiving the first section of the first cable. In other examples, the cable lock includes a spool, the first cable being wound in a first direction around the spool and the second cable being wound in a second direction around the spool, the second direction being opposite the first direction.

In some implementations, the first section of the first cable extends to a first anchor point on the medial side of the upper and the second section of the first cable extends a second anchor point on the medial side of the upper. The first anchor point may be disposed on a medial side of the upper in a midfoot region adjacent to a bite line of the upper and the sole structure and the second anchor point may be disposed at a distal end of a flap disposed on the medial side of the upper in a forefoot region. The flap may extend from a proximal end attached at the bite line to the distal end adjacent to an instep region of the upper. The flap may include a loop for receiving the second section of the first cable, the loop receiving a first segment and a second segment of the second section, and the second anchor point receiving a third segment of the second section.

The details of one or more implementations of the disclosure are set forth in the accompanying drawings and the description below. Other aspects, features, and advantages will be apparent from the description and drawings, and from the claims.

Referring to FIG. 1, an example of an article of footwear 10 including a system providing for variable tension is disclosed. In some implementations, the article of footwear 10 includes an upper 100 and a sole structure 200 attached to the upper 100. The article of footwear 10 further includes a tensioning system 300 integrated into at least one of the upper 100 and the sole structure 200. The tensioning system 300 includes a cable lock 302 and a pair of cables 304, 306 that cooperate with the cable lock 302 to move the article of footwear 10 between a tightened state and a loosened state, as detailed below. Particularly, the cables 304, 306 are movable in a tightening direction $D_T$ to move the article of footwear 10 into the tightened state. In some implementations, the upper 100 and the sole structure 200 cooperate to provide passages and guides for routing portions of the cables 304, 306 through the cable lock 302. The cable lock 302 is configured to selectively secure the cables 304, 306 in the tightened state.

Figure 4:
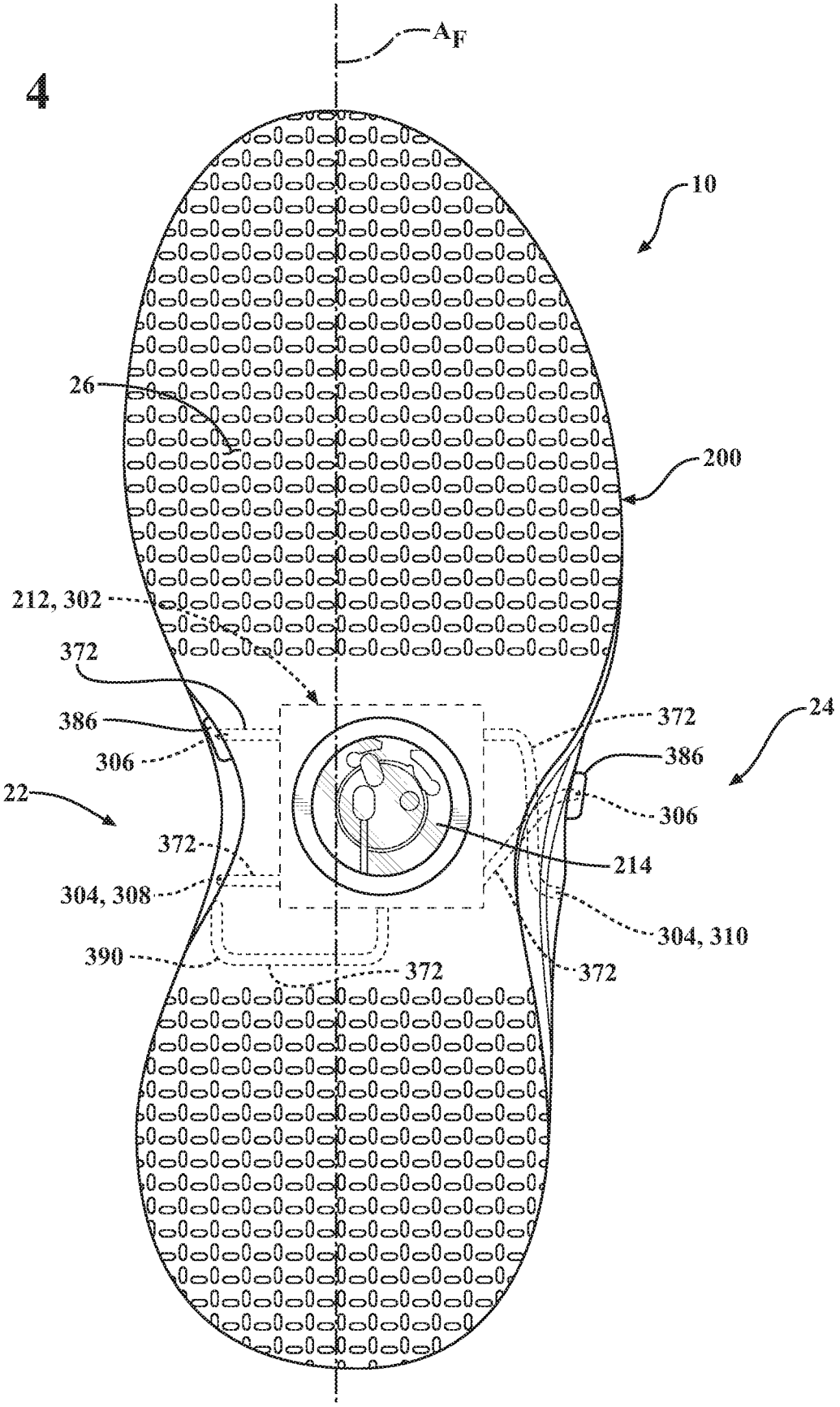
FIG. 4 is a bottom view of the article of footwear of FIG. 1, showing the cable lock exposed through a sole structure of the footwear.

The article of footwear 10 may be divided into one or more regions. The regions may include a forefoot region 12, a mid-foot region 14 and a heel region 16. The forefoot region 12 may correspond with toes and joints connecting metatarsal bones with phalanx bones of a foot. The forefoot region 12 may be subdivided into a toe portion $\mathbf{12}_T$ corresponding with phalanges and a ball portion $\mathbf{12}_B$ associated with metatarsal bones of a foot. The mid-foot region 14 may correspond with an arch area of the foot, and the heel region 16 may correspond with rear regions of the foot, including a calcaneus bone. The footwear 10 may further include an anterior end 18 associated with a forward-most point of the forefoot region 12, and a posterior end 20 corresponding to a rearward-most point of the heel region 16. As shown in FIG. 4, a longitudinal axis $A_F$ of the footwear 10 extends along a length of the footwear 10 from the anterior end 18 to the posterior end 20, and generally divides the footwear 10 into a lateral side 24 and a medial side 22. Accordingly, the lateral side 24 and the medial side 22 respectively correspond with opposite sides of the footwear 10 and extend through the regions 12, 14, 16.

The upper 100 includes interior surfaces that define an interior void 102 configured to receive and secure a foot for support on the sole structure 200. An ankle opening 104 in the heel region 16 may provide access to the interior void 102. For example, the ankle opening 104 may receive a foot to secure the foot within the void 102 and facilitate entry and removal of the foot to and from the interior void 102. The upper 100 may include a tongue portion 106 that extends between the lateral side 24 and the medial side 22 and covers the interior void 102. The upper 100 may include one or more grip features 108 formed adjacent the ankle opening 104 for pulling the footwear 10 onto and off of the foot. The upper further includes a heel counter 110 extending from the medial side 22 to the lateral side 24 around the posterior end 20 of the upper 100.

Figure 3A:
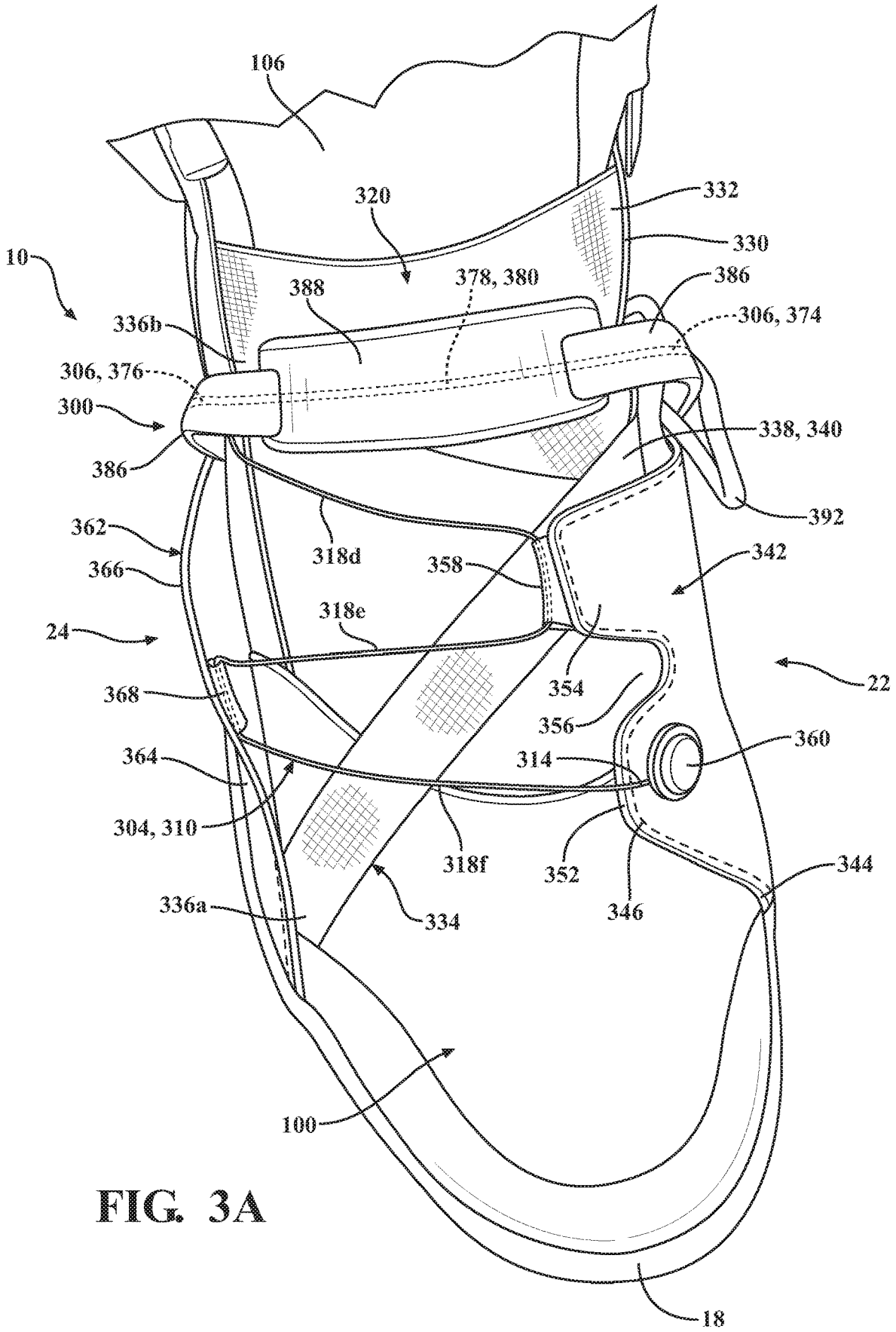
FIG. 3A is a fragmentary top perspective view of the article of footwear of FIG. 1, where a shroud of the footwear is hidden to show internal components of the footwear.
Figure 3B:
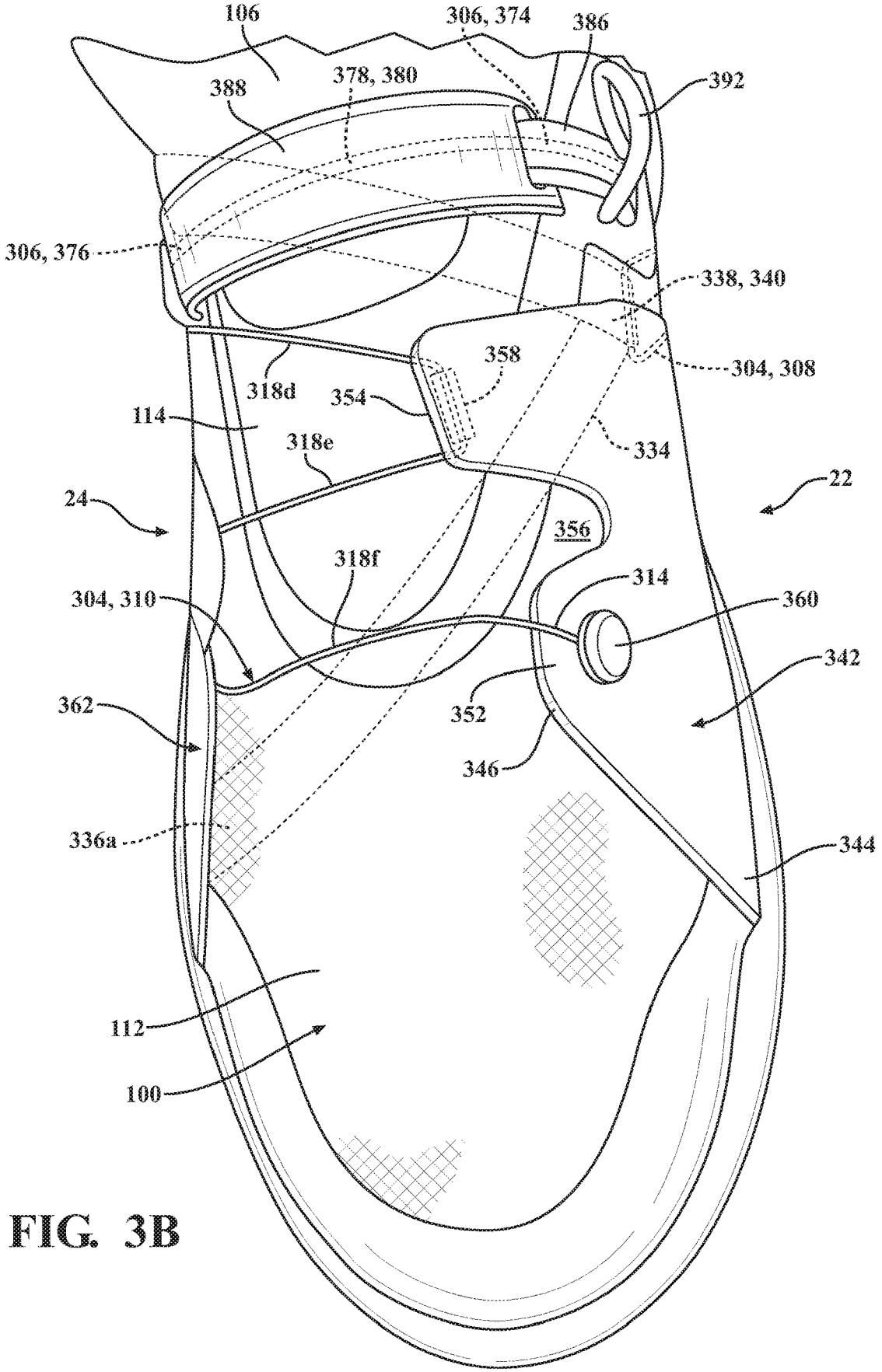
FIG. 3B is a partial, top perspective view of the article of footwear of FIG. 1, where the shroud is shown and conceals the internal components of the footwear.

The upper 100 may be formed from one or more materials that are stitched or adhesively bonded together to define the interior void 102. Suitable materials of the upper 100 may include, but are not limited, textiles, foam, leather, and synthetic leather. The example upper 100 may be formed from a combination of one or more substantially inelastic or non-stretchable materials and one or more substantially elastic or stretchable materials disposed in different regions of the upper 100 to facilitate movement of the upper 100 between the tightened state and the loosened state. The one or more elastic materials may include any combination of one or more elastic fabrics such as, without limitation, spandex, elastane, rubber or neoprene. The one or more inelastic materials may include any combination of one or more of thermoplastic polyurethanes, nylon, leather, vinyl, or another material/fabric that does not impart properties of elasticity. As illustrated best in FIGS. 3A and 3B, the upper may be provided with one or more shrouds 112 and/or covers 114 for concealing the various components of the tensioning system 300. For example, in FIG. 3A, the upper 100 is shown without the shrouds 112 and covers 114, whereby at least one of the straps of the tensioning system 300 exposed. In contrast, FIG. 3B shows a mesh shroud 112 covering the forefoot region 12 of the upper 100, while the tongue portion 106 of the upper 100 may be provided with a cover 114. In some examples, the cover 114 may be removable by the user to expose the tensioning system 300.

As provided above, the sole structure 200 is attached to the upper 100 and defines a ground-engaging surface 26 of the footwear 10. The sole structure 200 includes a top surface 202 and a bottom surface 204 formed on an opposite side of the sole structure 200 from the top surface 202. The bottom surface 204 of the sole structure 200 may define the ground-engaging surface 26 of the footwear. The sole structure 200 further includes a peripheral side surface 206 extending between the top surface 202 and the bottom surface 204, such that the peripheral side surface 206 defines an outer perimeter of the sole structure 200. The sole structure 200 extends continuously from a first end 208 at the anterior end 18 of the footwear 10 to a second end 210 at the posterior end 20 of the footwear 10. As referred to throughout the application and the accompanying claims, the sole structure 200 and the upper 100 define a 'bite line' 28 where the peripheral side surface 206 and the upper 100 intersect when the footwear 10 is assembled. The bite line 28 can extend along the footwear 10 entirely from the first end 208 to the second end 210 on either or both of the lateral side and the medial side, and can also extend around the first end 208, the second end 210, or both.

As described in greater detail below, the sole structure 200 is configured to receive a portion of the tensioning system 300 therein, and may include one or more cavities or conduits formed therein. In the illustrated example, the sole structure 200 includes an aperture or cavity 212 formed in the bottom surface 204. The cavity 212 is configured to receive the cable lock 302 within the sole structure 200. In some examples, the cable lock 302 may be encapsulated within the sole structure 200. As shown in the example of FIG. 4, the cavity 212 may be configured to receive the cable lock 302 such that a portion of the cable lock 302 is exposed or visible through the bottom surface 204 of the sole structure 200. For example, the cable lock 302 may be recessed from the bottom surface 204 of the sole structure 200, such that a portion of the cavity 212 formed between the cable lock 302 and the bottom surface 204 defines a view port through which the cable lock is exposed. Here, the cavity 212 or the cable lock 302 may include a transparent barrier 214 providing a window 214 into an interior of the cable lock 302. Accordingly, internal components of the cable lock 302 may be visible through the barrier 214 so that operation of the cable lock 302 can be observed by the user.

As introduced above, the tensioning system 300 generally includes a first cable 304 and a second cable 306, which cooperate with each other via the cable lock 302 to selectively transition the upper 100 between a tightened state and a relaxed state. As shown, the first cable 304 is routed along the upper 100 through a plurality of guides and straps, whereby a tightening force $F_T$ applied to the second cable 306 by the user is transmitted to the first cable 304 through the cable lock 302, and is distributed along the upper 100 by the first cable 304 to tighten the upper 100 along the foot. As shown, the first cable 304 may be described as including a first section 308 and a second section 310 that are connected to each other through the cable lock 302. The first section 308 extends from the cable lock 302 to a terminal end 312 anchored to the upper 100 in the mid-foot region 14. Likewise, the second section 310 extends from the cable lock 302 to a terminal end 314 anchored to the upper 100 in the forefoot region 12. As discussed below, the first section 308 of the first cable 304 may be described as comprising a first plurality of segments 316*a*-316*e* routed along the upper 100 between the cable lock 302 and the terminal end 312 of the first section 308. Similarly, the second section 310 may be described as including a second plurality of segments 318*a*-318*f* routed along the upper 100 between the cable lock 302 and the terminal end 314 of the second section 310.

As provided above, the tensioning system 300 includes a plurality of guides, loops, and straps through which the first and second sections 308, 310 of the first cable 304 are routed to translate a tensional force of the first cable 304 into a tightening force along the upper 100. A first strap 320 extends across the tongue portion 106 adjacent to the ankle opening 104, from a first end 322 on the medial side 22 of the upper 100 to a second end 324 on the lateral side 24 of the upper 100. More particularly, the first end 322 of the first strap 320 is positioned on the medial side 22 of the upper 100 adjacent to the tongue portion 106, and between the mid-foot region 14 and the heel region 16. Similarly, the second end 324 of the first strap 320 is positioned on the lateral side 24 of the upper 100, adjacent to the tongue portion 106, and between the mid-foot region 14 and the heel region 16. The first end 322 of the first strap 320 defines a first loop 326, which receives a portion of the first section 308 of the first cable 304 on the medial side 22, and the second end 324 of the first strap 320 defines a second loop 328, which receives a portion of the second section 310 of the first cable 304 on the lateral side 24. As described below, when the first cable 304 is tightened, the loops 326, 328 of the first strap 320 are drawn towards the sole structure 200 to tighten the first strap 320 over the tongue portion 106.

Aside from having the first and second sections 308, 310 of the first cable 304 routed through the loops 326, 328, the first strap 320 is completely detached from the upper 100. As such, the first strap 320 can be drawn tight over the upper 100 by the first and second sections 308, 310 of the first cable 304 to tighten the upper 100. The upper 100 may include one or more guides 330 for maintaining an orientation and position of the first strap 320 across the upper 100. In the illustrated example, the upper 100 includes a pair of the guides 330, whereby one of the guides 330 is disposed at the first end 322 of the first strap 320 and the second one of the guides 330 is disposed at the second end 324 of the first strap. Accordingly, the guides 330 receive the ends 322, 324 of the first strap 320. In one example, the guides 330 are each formed by stitching opposing ends of a fabric strap to the upper 100 to form a passage 332 between the strap and the upper 100. However, in other examples, the guides 330 may be formed of rigid materials and/or may wholly define the passage 332.

The tensioning system 300 further includes a second strap 334 extending from at least one proximal end 336 to a distal end 338. As best shown in FIG. 3A, the second strap 334 extends from a first proximal end 336*a* attached to the bite line 28 on the lateral side 24 in the forefoot region 12, up to a free-hanging distal end 338 adjacent to the tongue portion 106 on the medial side 22 in the mid-foot region 14, and back down to a second proximal end 336*b* attached to the bite line 28 on the lateral side 24 in the heel region 16. Accordingly, the second strap 334 is turned from the first proximal end 336*a* to the second proximal end 336*b* at the distal end 338 to form a loop 340 at the distal end 338. As discussed in greater detail below, a portion of the first section 308 of the first cable 304 is routed through the loop 340 of the second strap 334 such that when the first section 308 of the first cable 304 is pulled in the tightening direction $D_T$, the loop 340 of the second strap 334 is drawn down the medial side 22 to tighten around the upper 100.

Referring to FIG. 1, the tensioning system 300 includes a medial flap 342 having a proximal end 344 attached at the bite line 28 and a free-hanging distal end 346 adjacent to the tongue portion 106 of the upper 100 on the medial side 22. As shown, the proximal end 344 of the medial flap 342 extends along the bite line 28 from the toe portion $12_T$ to the mid-foot region 14. A width $W_{MF}$ of the medial flap 342 tapers from the proximal end 344 to the distal end 346, whereby the width $W_{MF}$ of the medial flap 342 at the distal end 346 is less than the width $W_{MF}$ of the medial flap 342 at the proximal end 344.

The distal end 346 of the medial flap 342 may include a pair of tabs 352, 354 that are separated from each other by a gap 356. Specifically, the distal end 346 includes an anterior tab 352 disposed adjacent an anterior-facing edge of the medial flap 342 and a posterior tab 354 disposed adjacent to a posterior-facing edge of the medial flap 342. The tabs 352, 354 are independently moveable relative to each other. As shown, the posterior tab 354 includes a cable guide 358 configured to receive a portion of the first section 308 of the first cable 304, while the terminal end 312 of the first section 308 of the first cable 304 is fixed to the anterior tab 352 at a first anchor 360.

Figure 2:
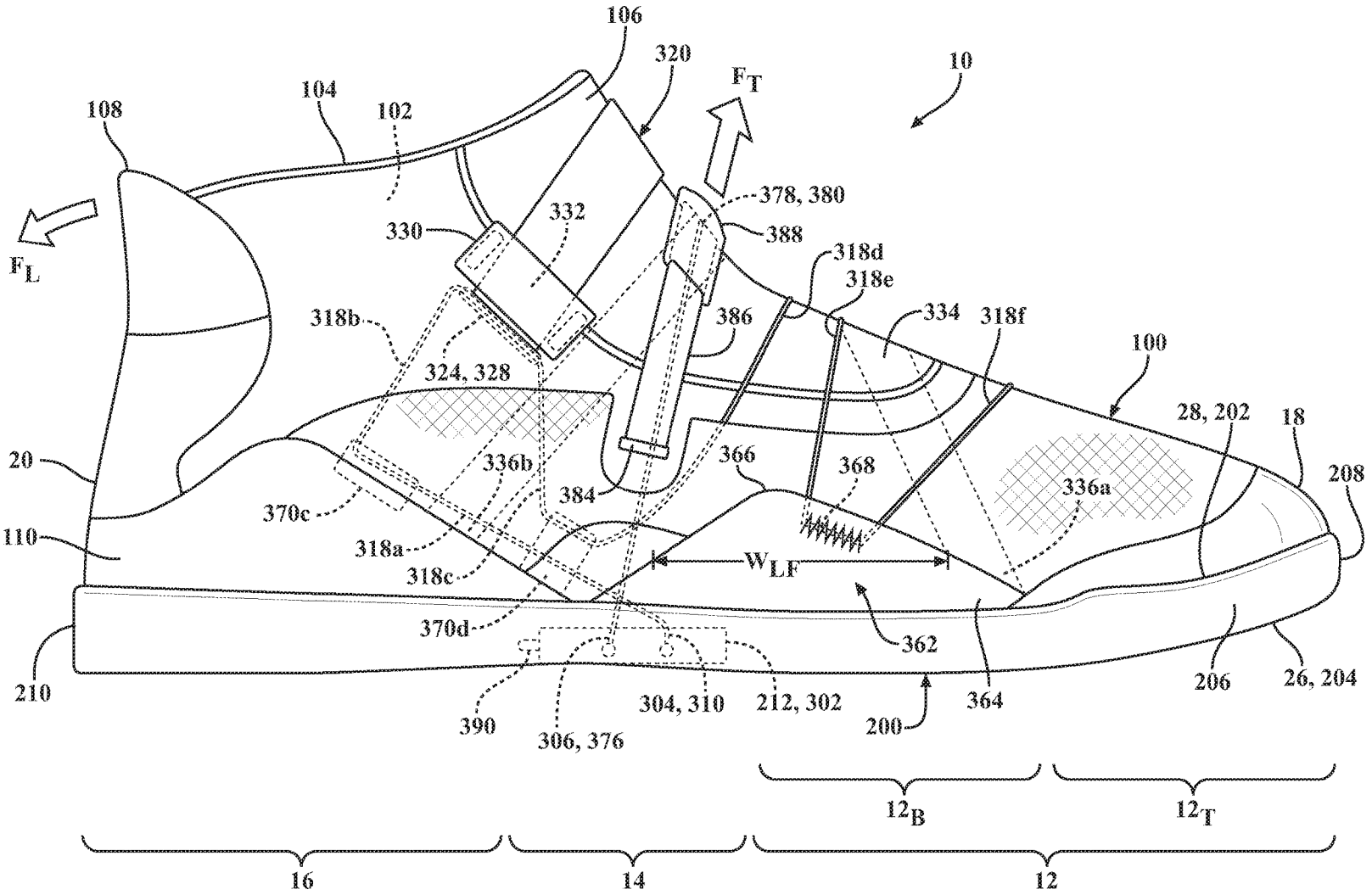
FIG. 2 is a lateral side elevation view of the article of footwear of FIG. 1.

Referring to FIG. 2, the lateral side 24 of the footwear 10 includes a lateral flap 362 having a proximal end 364 attached at the bite line 28 and a free-hanging distal end 366 adjacent to the tongue portion 106 in the ball portion $12_B$ of the forefoot region 12. As with the medial flap 342, a width $W_{LF}$ of the lateral flap 362 tapers from the proximal end 364 to the distal end 366. The lateral flap 362 includes a cable guide 368 disposed proximate to the distal end 366. As discussed below, the second section 310 of the first cable 304 is routed through the cable guide 368 of the lateral flap 362. Accordingly, because the distal end 366 is independent of the upper 100, the distal end 366 can be drawn along the upper 100 towards the medial side 22 when the first cable 304 is moved in the tightening direction $D_T$.

As described in greater detail below with respect to the routings of the first and second sections 308, 310 of the first cable 304, the tensioning system 300 includes a plurality of cable guides 370 disposed in locations along the upper 100 for routing the first cable 304 between the aforementioned straps 320, 334 and flaps 342, 362. In the illustrated example, the cable guides 370 are formed by fabric or mesh loops defining a passage for slidably receiving the first cable 304 therethrough. In some examples, the inner surfaces of the cable guides 370 are lined or coated with a low-friction material, such as a lubricous polymer (e.g., polytetrafluoroethylene), that facilitates movement of the first cable 304 therein.

Furthermore, the tensioning system 300 may include one or more conduits 372 formed through the sole structure 200 for routing ends of the first cable 304 and the second cable 306 between the cable lock 302 and the upper 100, as best shown in FIG. 4.

Referring to FIG. 1, the first section 308 of the first cable 304 is generally routed along the medial side 22 of the upper 100. More particularly, the first section 308 of the first cable 304 extends from the cable lock 302 in the sole structure 200, up through the bite line 28 on the medial side 22, and is routed through each of the first loop 326 of the first strap 320 and the loop 340 of the second strap 334 via a series of the cable guides 370. The first section 308 of the first cable 304 terminates at the terminal end 312, which is anchored to the medial side 22 of the upper 100, adjacent to the bite line 28 in the mid-foot region 14.

As provided above, the first section 308 of the first cable 304 may be described as comprising a plurality of segments 316. As best shown in FIG. 1, a first segment 316*a* of the first section 308 is routed from a first end at the bite line 28 in the mid-foot region 14 to a second end in the heel region 16, spaced apart from the bite line 28. As shown, the second end of the first segment 316*a* is defined where the first section 308 of the first cable 304 passes through a first one of the cable guides 370*a*. A second segment 316*b* of the first cable 304 extends from the first one of the cable guides 370*a* to the first loop 326 of the first strap 320, where the first section 308 is routed through the first loop 326 to a third segment 316*c*. The third segment 316*c* then extends from the first loop 326 of the first strap 320 to a second one of the cable guides 370*b* attached to the upper 100 above the first segment 316*a* and forward of the first one of the cable guides 370*a*. The first section 308 is then routed through the second one of the cable guides 370*b* to a fourth segment 316*d*, which extends up the upper 100 from the second cable guide 370*b* to the loop 340 of the second strap 334, adjacent to the tongue portion 106 in the mid-foot region 14. The first section 308 is then routed through the loop 340 of the second strap 334 to a fifth segment 316*e*, which extends from the loop 340 to the terminal end 312 of the first section 308 adjacent to the bite line 28.

As shown, each of the first cable guide 370*a*, the second cable guide 370*b*, and the terminal end 312 may be fixed to the upper 100 adjacent to an edge of the heel counter 110. Because the cable guides 370*a*, 370*b* and the terminal end 312 are fixed to the upper 100, the segments 316*a*-316*e* of the first section 308 will draw the first loop 326 of the first strap 320 and the loop 340 of the second strap 334 down towards the heel counter 110 when the first cable 304 is moved in the tightening direction $D_T$, as described in greater detail below.

Referring to FIG. 2, the second section 310 of the first cable 304 is generally routed along the lateral side 24 and a lower region of the tongue portion 106 of the upper 100. More particularly, the second section 310 of the first cable 304 extends from the cable lock 302 in the sole structure 200, up through the bite line 28 on the lateral side, and is routed through each of the second loop 328 of the first strap 320, the cable guide 358 of the medial flap 342, and the cable guide 368 of the lateral flap 362 via a series of the cable guides 370. The second section 310 of the first cable 304 terminates at the terminal end 314, which is anchored to the anterior tab 352 at the distal end 346 of the medial flap 342.

As provided above, the second section 310 of the first cable 304 may be described as comprising a plurality of segments 318. As best shown in FIG. 2, a first segment 318*a* of the second section 310 is routed from a first end at the bite line 28 in the mid-foot region 14 to a second end in the heel region 16, spaced apart from the bite line 28. As shown, the second end of the first segment 318*a* is defined where the second section 310 of the first cable 304 passes through a third one of the cable guides 370*c*. A second segment 318*b* of the second section 310 extends from the third one of the cable guides 370*c* to the second loop 328 of the first strap 320, where the second section 310 is routed through the second loop 328 to a third segment 318*c*. The third segment 318*c* then extends from the second loop 328 of the first strap 320 to a fourth one of the cable guides 370*d* attached to the upper 100 above the first segment 318*a* and forward of the third one of the cable guides 370*c*. The second section 310 is then routed through the fourth one of the cable guides 370*d* to a fourth segment 318*d*, which extends from the fourth cable guide 370*d* on the lateral side 24 and across the tongue portion 106 to the cable guide 358 on the posterior tab 354 of the medial flap 342. The second section 310 is then routed through the cable guide 358 of the posterior tab 350 to a fifth segment 318*e*, which extends from the cable guide 358 of the posterior tab 350 and across the tongue portion 106 to the cable guide 368 of the lateral flap 362. The second section 310 is routed through the cable guide 368 of the lateral flap 362 to a sixth segment 318*f*, which extends from the cable guide 368 and across a vamp of the upper 100 to the terminal end 314. The routing of the fourth segment 318*d*, the fifth segment 318*e*, and the sixth segment 318*f* can be clearly seen in FIG. 3A. As shown, the terminal end 314 of the second section 310 is anchored to the anterior tab 352 by the anchor point 360.

As shown, each of the third cable guide 370*c* and the fourth cable guide 370*d* may be fixed to the upper 100 adjacent to an edge of the heel counter 110. Because the cable guides 370*c*, 370*d* are fixed to the upper 100, the second and third segments 318*c*, 318*d* of the second section 310 will draw the second loop 328 down towards the heel counter 110 when the first cable 304 is moved in the tightening direction $D_T$, as described in greater detail below. Simultaneously, when the first cable is moved in the tightening direction, the fourth segment 318*d*, the fifth segment 318*e*, and the sixth segment 318*f* will tighten over the top of the upper 100 and will draw the distal ends 346, 366 of the flaps 342, 362 towards each other to tighten the interior void 102 around the foot.

Like the first cable 304, the second cable 306 may be described as including a first section 374 extending from a first side of the cable lock 302 to the medial side 22 of the footwear 10 and a second section 376 extending from a second side of the cable lock 302 to the lateral side 24 of the footwear 10. In the illustrated example, the first section 374 and the second section 376 cooperate to define a continuous loop extending around the upper 100, and more particularly, over the tongue portion 106 of the upper 100. Although substantially continuous, the first section 374 may be described as extending to a first end 378 and the second section 376 may be described as extending to a second end 380. Here, the first end 378 and the second end 380 are coincident with each other to form a continuous second cable 306. However, in other examples, the first end 378 and the second end 380 can be separated from each other, and/or may be connected to each other by an intermediate member.

As best shown in FIG. 3A, the second cable 306 extends around the tongue portion 106 proximate to the ankle opening 104 (i.e., proximate to an area above an instep of a wearer's foot). As shown in FIG. 1, a portion of the first section 374 of the second cable 306 may be routed through a first passage 382 formed through the medial side 22 of the upper 100. Likewise, a portion of the second section 376 of the second cable may be routed through a second passage 384 formed through the lateral side 24 of the upper 100.

The portions of the second cable 306 that extend around the tongue portion 106 may be enclosed within one or more sheaths 386. Each sheath 386 may additionally be formed from a material and/or a weave that allows the sheath 386 and each section 374, 376 of the second cable 306 to move from a relaxed state to a stretched or expanded state when the second cable 306 is moved in a direction away from the upper 100 by way of the tightening force $F_T$ (i.e., when the second cable 306 is moved in the tightening direction $D_T$). When the tightening force $F_T$ is removed, the material and/or weave of the sheath 386 automatically causes the sheath 36 to contract to the relaxed state and accommodate bunching by the second cable 306 therein.

In the example shown, a separate tightening grip 388 operatively connects to the sheath 386 at an attachment location proximate to the tongue portion 106 to allow a user to apply the tightening force $F_T$ to pull the second cable 306 away from the upper 100, thereby causing each of the second cable 306 and the first cable 304 to move in the tightening direction $D_T$. Other configurations may include operatively connecting one or more tightening grips 388 to other portions of the sheath 386 along the length of the second cable 306. In some implementations, the tightening grip 388 is omitted and the sheath 386 is gripped directly by the user.

Referring again to FIG. 1, the cable lock 302 may further include a release mechanism 390 operable to transition the cable lock 302 from a locked state to an unlocked state to permit the cables 304, 306 to move in both directions $D_T$, $D_F$. For instance, the release mechanism 390 may include a release cord or cable 390 operable to transition the cable lock 302 from the locked state to the unlocked state when the release cord 390 is pulled. The release cord 390 may extend through one of the passages 382, 384 formed by the upper 100 from a first end attached to the cable lock 302 to a distal end exposed from the upper 100, thereby permitting a user to grip and pull the release cord 390 for moving the locking device 350*b* from the locked state to the unlocked state. In some examples, the distal end of the release cord 390 includes a loop 392 and/or gripping feature located remotely from the cable lock 302 to allow a user to grip and pull the release cord 390 when it is desirable to move the cable lock 302 into the unlocked state and/or release the cable lock 302 from the unlocked state. FIG. 1 shows the loop 392 of the release cord 390 extending from the first passage 382 on the medial side 22 of the upper 100.

As discussed above, the locking device or cable lock 302 may be disposed within sole structure 200 of the footwear 10 and may be biased to a locked state to restrict movement of the cables 304, 306 in the their respective loosening directions $D_L$. The sole structure 200 supports the cable lock 302 in some examples. The first cable 304 and the second cable 306 each approach and pass through a housing 400 of the cable lock 302 from opposite directions. In one configuration, the housing 400 includes a substantially square shape that is approximately three inches (3 in.) long by three inches (3 in.) wide and includes a thickness that is approximately one inch (1 in.). In some configurations, the cable lock 302 permits movement of the cables 304, 306 in the tightening directions $D_T$ while in the locked state. The release cord 390 may transition the cable lock 302 from the locked state to an unlocked state to thereby permit the cables 304, 306 to move in both directions $D_T$, $D_F$.

Figure 5:
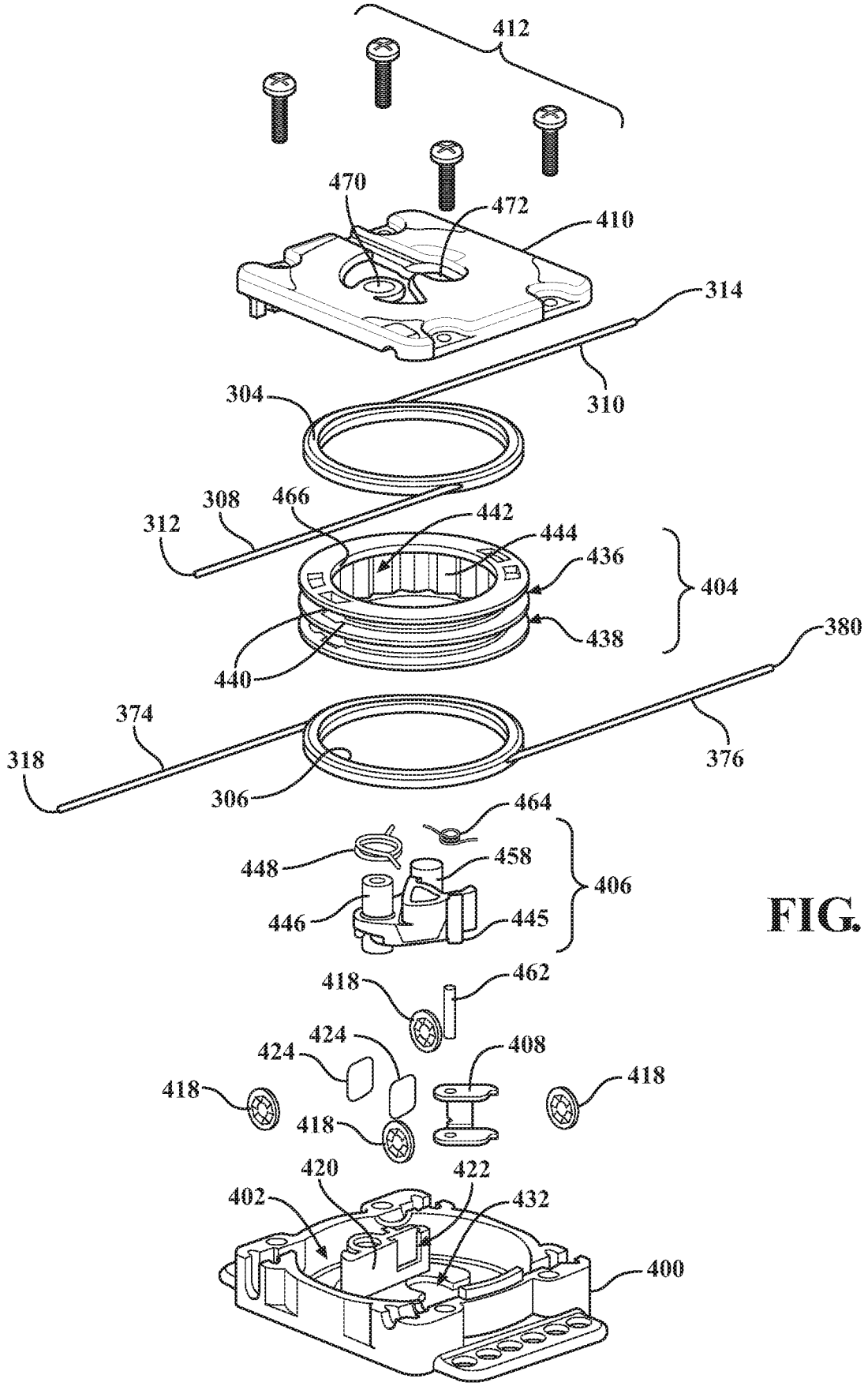
FIG. 5 is an exploded view of a cable lock in accordance with the principles of the present disclosure.

FIG. 5 provides an exploded view of the cable lock 302, showing the housing 400 defining a cavity 402 configured to rotatably receive a spool 404, a first pawl 406, and a second pawl 408. The cable lock 302 may include a lid 410 releasably fastened to the housing 400 to prevent access to the cavity 402 when the lid 410 is fastened to the housing 400 and to allow access to the cavity 402 when the lid 410 is removed from the housing 400. One or more fasteners 412 may extend through the lid 410 and fasten with threaded holes 414 in the housing 400 to secure the lid 410 to the housing 400.

The housing 400 defines a plurality of retainer slots 416 each configured to receive and support a respective cable retainer 418 through which the cables 304, 306 are routed into the cavity 402 of the housing 400. The housing 400 may support a plurality of the cable retainers 418 such that the ends of the cables 304, 306 each extend through a respective one of the cable retainers 418.

As described in greater detail below, the housing 400 may further include a retaining wall 420 disposed within the cavity 402. The retaining wall 420 is configured to cooperate with the first pawl 406. The retaining wall 420 may further include a tactile slot 422 configured to receive one or more tactile domes 424. Described in greater detail below with reference to FIGS. 6-9, the first pawl 406 may engage the tactile dome(s) 424 to provide a click or other sound that indicates the spool 404 has changed positions relative to the housing 400 and/or the cable lock 302 has transitioned from the locked state to the unlocked state.

Figure 7:
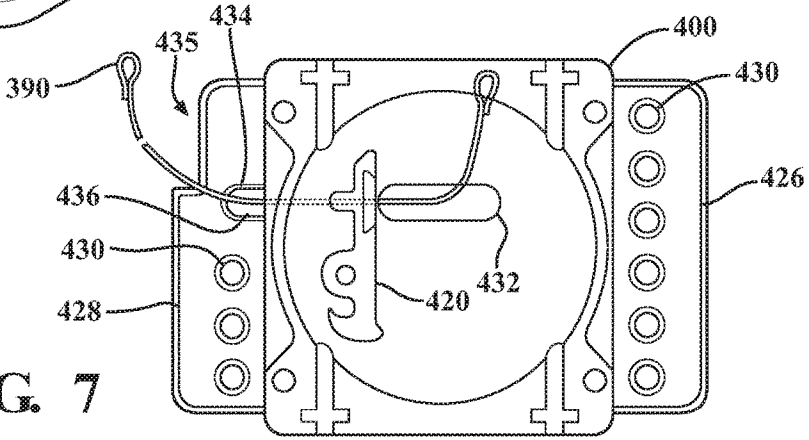
FIG. 7 is a top view of the cable lock of FIG. 5, where internal components of the cable lock are hidden to show a construction of a housing of the cable lock.

FIG. 7 provides a top view of the housing 400 showing a pair of mounting flanges 426, 428 disposed on opposite sides of the housing 400. The mounting flanges 426, 428 may rest upon an inner surface of the cavity 212 of the sole structure 200 to mount the cable lock 302 within the sole structure 200. Alternatively, the flanges may attach to a strobel of the upper 100. The strobel can be any support structure forming an underfoot portion of the footwear 10 that is at least disposed between the sole structure 200 and the void 102. In some examples, bonding agents, such as adhesives and/or epoxies, may be applied to the contact surfaces of the flanges 426, 428 and/or the inner surface of the cavity 212 of the sole structure 200 for attaching the housing 400 within the cavity 212. Additionally or alternatively, the mounting flanges 426, 428 may define one or more mounting holes 430 formed therethrough and configured to receive a fastener (not shown) for mounting the housing 400 to the sole structure 200.

FIG. 7 shows the housing 400 with the pawls 406, 408, cables 304, 306, and other components of the cable lock 302 removed to expose an elongate channel 432 formed through the housing 400. As discussed in greater detail below, the elongate channel 432 aligns with an attachment point of the first pawl 406 and permits the release cord 390 to pass underneath the housing 400 and up through a feed slot 434 defined by the mounting flange 428. The mounting flange 428 also defines a cut-out region 435 proximate to the feed slot 434 to provide more clearance for the release cord 390 (and/or a conduit 372 enclosing the release cord 390) to extend from the housing 400. The mounting flanges 426, 428 may define a lip around the perimeter of the housing 400 so that the housing 400 is spaced apart from the mounting surface of the cavity 212 or the strobel, allowing the release cord 390 to be routed between the housing 400 and the mounting surface of the cavity 212 or strobel. Thus, the release cord 390 may freely extend underneath the housing 400 between the elongate channel 432 and the feed slot 434. In some examples, the feed slot 434 has a curved edge to prevent the release cord 390 from catching or being restricted by the housing 400.

Figure 6:
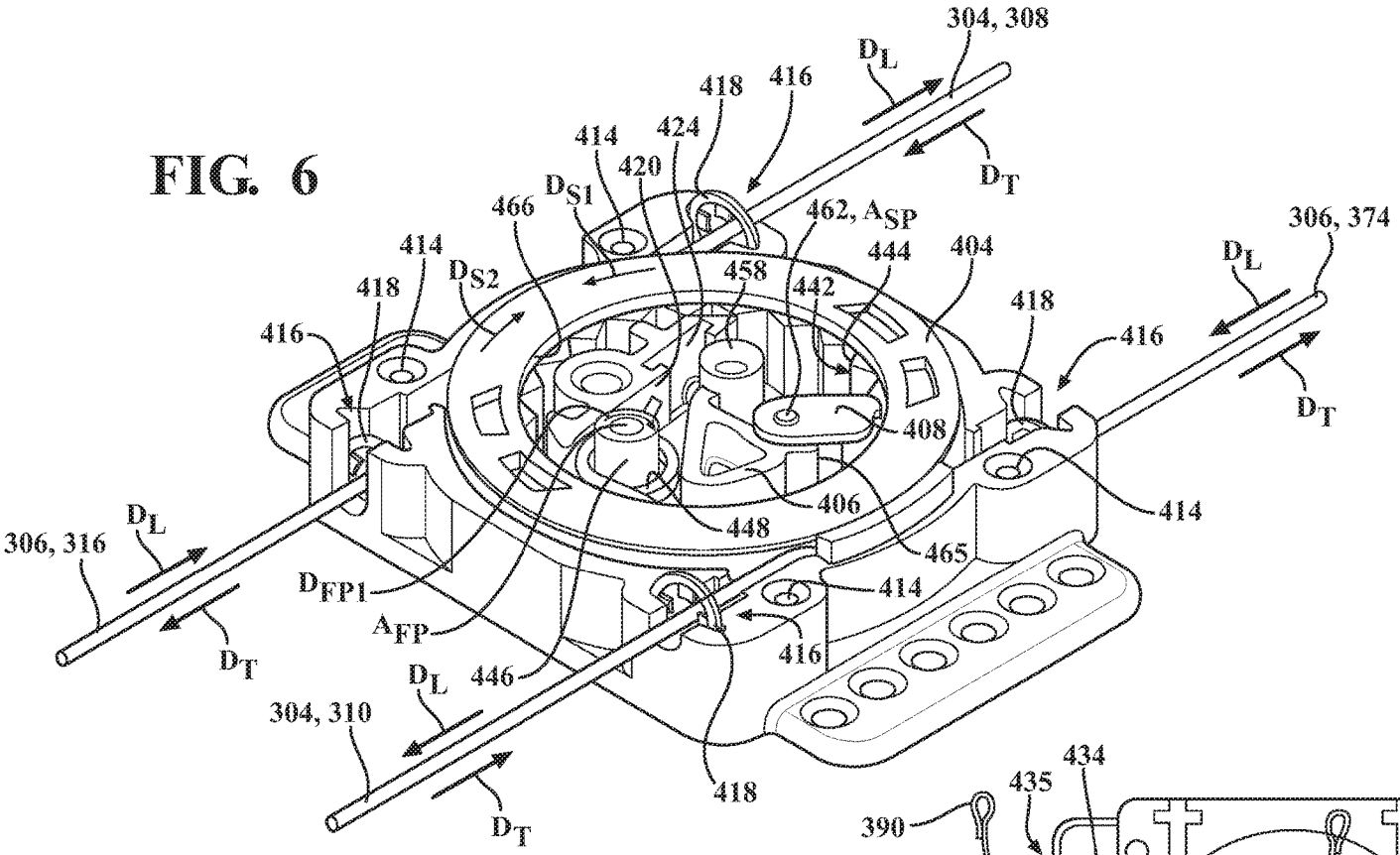
FIG. 6 is a perspective view of the cable lock of FIG. 5.

Referring now to FIG. 6, the spool 404 is supported within the cavity 402 of the housing 400 and may rotate relative to the housing 400. In some examples, the spool 404 rotates relative to the housing 400 in a first direction $D_{S1}$ when the cables 304, 306 move in the tightening direction $D_T$ and in an opposite second direction $D_{S2}$ when the cables 304, 306 move in the loosening direction $D_L$. The spool 404 includes a first channel or annular groove 436 configured to collect portions of the first cable 304 and a second channel or annular groove 438 configured to collect portions of the second cable 306. The spool 404 may include one or more anchor slots 440 formed through a divider wall separating the channels 436, 438 for fixing a rotational position of each of the cables 304, 306 relative to the spool 404.

The cable lock 302 also includes a ratchet mechanism 442 associated with the spool 404 and having a plurality of teeth 444 positioned circumferentially around an axis of the ratchet mechanism 442 and protruding radially inward therefrom. In some implementations, the ratchet mechanism 442 is integrally formed upon an inner circumferential wall of the spool 404 such that the plurality of teeth 444 protrude radially inward from the channels 436, 438. In other examples, the ratchet mechanism 442 is supported for common rotation with the spool 404.

The first pawl 406 is disposed within the cavity 402 of the housing 400 and is configured to cooperate with the ratchet mechanism 442 to selectively prevent and allow rotation of the spool 404, and consequently, movement of the cables 304, 306. In some examples, the first pawl 406 includes one or more teeth 445 configured to selectively and meshingly engage with the plurality of teeth 444 of the ratchet mechanism 442. In some implementations, the first pawl 406 includes a first pawl axle 448 configured to support the first pawl 406 within the housing 400 to permit the first pawl 406 to rotate relative to the housing 400 about a first pawl axis of rotation $A_{FP}$.

A first pawl spring 450 may operably connect to the first pawl axle 448 and the retaining wall 420 disposed within the cavity 402 of the housing 400 to bias the first pawl 406 in a first direction $D_{FP1}$ about the pawl axis of rotation $A_{FP}$. The first pawl axis of rotation $A_{FP}$ may be substantially parallel to an axis of rotation of the spool 404 when the spool 404 is received by the cavity 402 to enclose the first pawl 406 and the retaining wall 420 of the housing 400. Accordingly, the first pawl spring 450 may interact with the retaining wall 420 and the first pawl 464 to exert a biasing force that causes the first pawl 406 to pivot about the pawl axis of rotation $A_{FP}$ in the first direction $D_{FP1}$ and into engagement with the plurality of teeth 444 of the ratchet mechanism 442, thereby causing the cable lock 302 to operate in the locked state to restrict movement by the cables 304, 306 in the loosening directions $D_L$.

Figure 8:
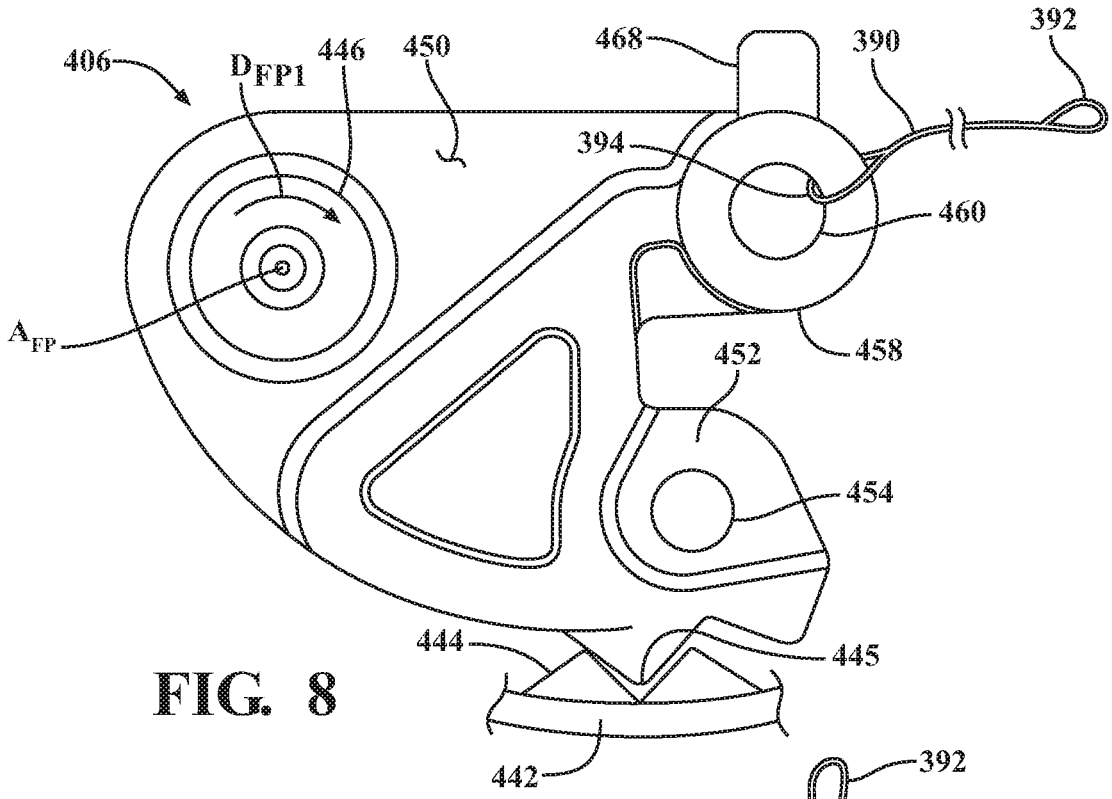
FIG. 8 is an enlarged fragmentary view of the cable lock of FIG. 6, showing the cable lock in a locked position.
Figure 9:
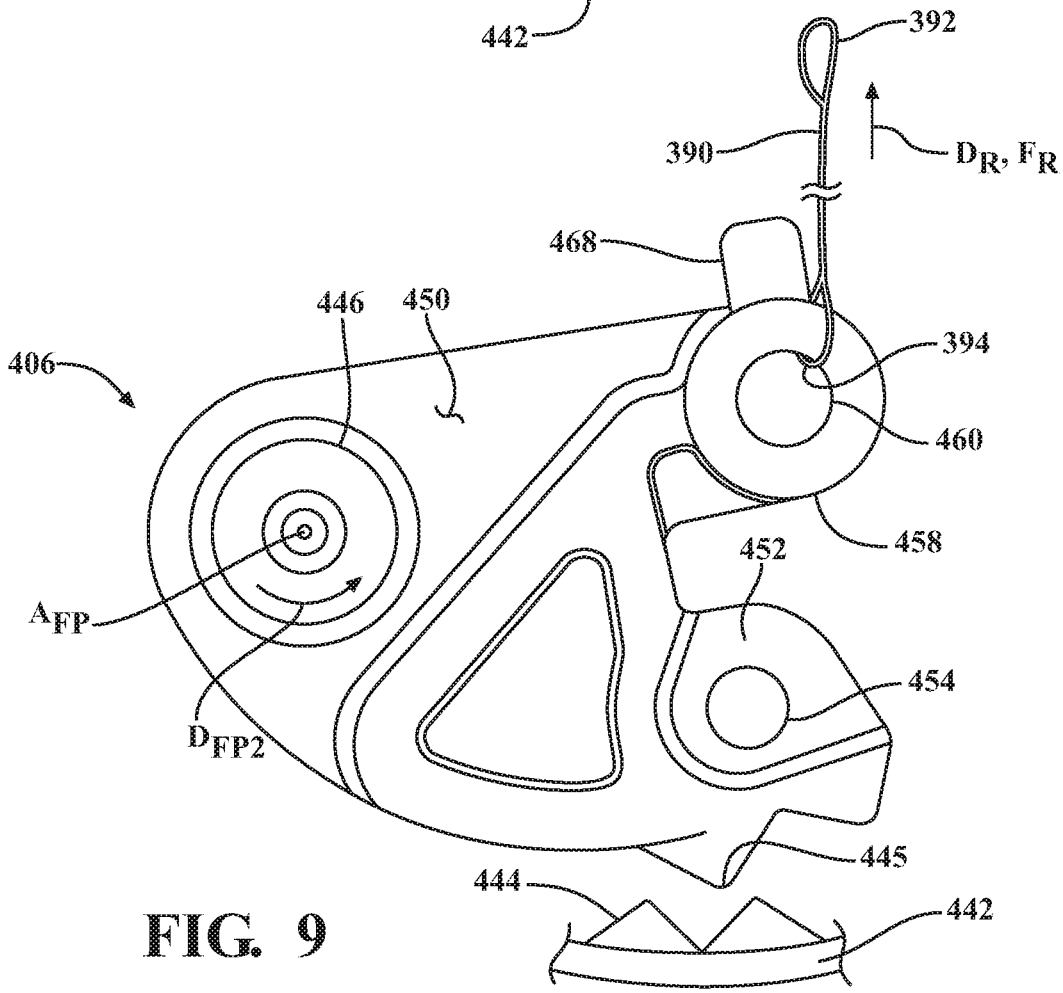
FIG. 9 is an enlarged fragmentary view of the cable lock of FIG. 6, showing the cable lock in an unlocked position.

FIGS. 8 and 9 each show a top view of the first pawl 406 of the cable lock 302. The first pawl 406 defines a first receiving surface 452 configured to support the first pawl spring 450. The first pawl axle 448 protrudes from the first receiving surface 452 in a direction substantially perpendicular to the first receiving surface 452. The first pawl axle 448 may be integrally formed with the first pawl 406. The first pawl 406 also defines a second receiving surface 454 configured to support a second pawl spring 464. An aperture 456 is formed through the second receiving surface 454 and is configured to receive a second pawl axle 462. An anchor post 458 may protrude away from the receiving surfaces 452, 454 in a direction substantially parallel to the first pawl axle 448. The anchor post 458 may define an aperture 460 to provide an attachment location for attaching the first end 354*d* of the release cord 390 to the anchor post 458. The anchor post 458 may be integrally formed with the first pawl 406.

With reference to FIG. 6, the second pawl axle 462 rotatably attaches the second pawl 408 to the first pawl 406 to permit the second pawl 408 to rotate relative to both the first pawl 406 and the housing 400 about a second pawl axis of rotation $A_{SP}$. The second pawl axis of rotation $A_{SP}$ may extend substantially parallel to the first pawl axis of rotation $A_{FP}$ and the axis of rotation of the spool 404. In some examples, the second pawl 408 is associated with the second pawl spring 464, which is configured to bias the second pawl 408 into engagement with a control surface 466 associated with an inner periphery of the spool 404 when the first pawl 406 is disengaged from the teeth 444 of the ratchet mechanism 442 to permit the spool 404 to rotate in the second direction $D_{S2}$.

FIG. 6 provides a perspective view of the cable lock 302 while in the locked state with the first pawl teeth 445 of the first pawl 406 engaging the teeth 444 of the ratchet mechanism 442 to selectively restrict the spool 404 from rotating in the second direction $D_{S2}$ and thereby restrict the cables 304, 306 from moving in their respective loosening directions $D_L$. In some examples, the plurality of the teeth 444 are sloped to permit the spool 404 to rotate in the first direction $D_{S1}$ when the teeth 445 of the first pawl 406 are engaged with the teeth 444 of the ratchet mechanism 442, thereby permitting the first cable 304 to move in the tightening direction $D_T$ and the second cable 306 to move in the tightening direction $D_T$ responsive to the tightening force $F_T$ being applied to the tightening grip 388.

When the spool 404 rotates in the first direction $D_{S1}$, the second cable 306 is unreeled from the second channel 438 of the spool 404 while the first channel 436 of the spool 404 simultaneously retracts the first cable 304 as the spool 404 rotates in the first direction $D_{S1}$. Accordingly, movement by the cables 304, 306 in their respective tightening directions $D_T$ causes an effective length of the second cable 306 to increase, while simultaneously causing an effective length of the first cable 304 to decrease, thereby moving the upper 100 into a tightened state for closing the interior void 102 around a foot of a user. Here, the second cable 306 incrementally moves in the tightening direction $D_T$ during each successive engagement between the first pawl 406 (e.g., first pawl teeth 445) and the teeth 444 of the ratchet mechanism 442 to thereby incrementally increase the tension applied to first and second sections 308, 310 of the first cable 304 for tightening the fit of the interior void 102 around the foot as the upper 100 moves into the tightened state. More particularly, because each of the first section 308 and the second section 310 of the first cable 304 are connected to and disposed within the first channel 436 of the spool 404, each of the sections 308, 310 will be wound and unwound by the spool 404 at the same rate, providing substantially uniform tightness of the upper 100 around the foot.

In some examples, the release cord 390 operably connects to the anchor post 458 of the first pawl 406 to selectively disengage the first pawl 406 from the teeth 444 of the ratchet mechanism 442 when a predetermined release for $F_R$ is applied to the release cord 390. When the second pawl 408 is engaged with the control surface 466, the second pawl 408 is operative to control the rotational speed of the spool 404 in the second direction $D_{S2}$ such that the cables 304, 306 do not become tangled when collected (e.g., wound) or released (e.g., unwound) from respective ones of the first channel 436 and the second channel 438 of the spool 404 during rotation in the second direction $D_{S2}$. In some configurations, the second pawl 408 includes two cam surfaces that remain engaged with respective ones of two control surfaces 466 when the first pawl 406 remains disengaged from the teeth 444 (i.e., when the cable lock 302 is operable in the unlocked state). Each control surface 466 may be axially disposed on an opposite side of the ratchet mechanism 442 such that the teeth 444 are disposed between the control surfaces 466 and protrude radially inward therefrom.

Referring to FIG. 8, the first pawl 406 is biased into engagement with the plurality of teeth 444 of the ratchet mechanism 442 when the cable lock 302 is in the locked state. Here, the first pawl 406 pivots and rotates about the first pawl axis of rotation $A_{FP}$ in the first direction $D_{FP1}$ such that the teeth 445 of the first pawl 406 engage with the teeth 444 of the ratchet mechanism 442. In some examples, the first pawl 406 includes a tactile protrusion 468 configured to engage with the tactile domes 424 to provide the "click" indicating the incremental change of position in the spool 404 during each successive engagement between the first pawl 406 and the teeth 444.

Referring to FIG. 9, an end 394 of the release cord 390 is attached to the anchor post 458 of the first pawl 406 to allow the release cord 390 to selectively disengage the first pawl 406 from the teeth 444 of the ratchet mechanism 442 when the predetermined release force $F_R$ is applied to the release cord 390. For example, a user may grasp the loop 392 of the release cord 390 and apply the predetermined force $F_R$ to disengage the first pawl 406 from the teeth 444 of the ratchet mechanism 442. Here, the predetermined force $F_R$ overcomes the biasing force of the first pawl spring 450 to allow the first pawl 406 to rotate about the first pawl axis of rotation $A_{FP}$ in a second direction $D_{FP2}$. Additionally, the tactile protrusion 468 may engage with the tactile dome 424 to provide the "click" when the predetermined force $F_R$ moves to the first pawl 406 out of engagement with the teeth 444 to transition the cable lock 302 to the unlocked state.

FIG. 9 shows the cable lock 302 in the unlocked state responsive to the release cord 390 selectively disengaging the first pawl 406 from the teeth 444 of the ratchet mechanism 442 when the predetermined force $F_R$ is applied to the release cord 390. While the cable lock 302 is in the unlocked state with the first pawl 406 disengaged from the teeth 444 of the ratchet mechanism 442, the spool 404 is permitted to rotate in the second direction $D_{S2}$ to allow the first cable 304 to move in the loosening direction $D_L$ when the loosening force $F_L$ is applied to the first cable 304. In some examples, the first channel 436 of the spool 404 collects the first cable 304 while the second channel 438 of the spool 404 simultaneously releases the second cable 306 as the spool 404 rotates in the second direction $D_{S2}$. Accordingly, movement of the second cable 306 in the loosening direction $D_L$ allows an effective length of the first cable 304 to increase to allow segments 316*a*-316*e*, 318*a*-318*f* to relax and thereby facilitate a transition of the upper 100 from the tightened state to the loosened state such that a foot can be removed from the interior void 102.

Referring back to FIG. 5, the lid 410 and the housing 400 of the cable lock 302 may each include a hub 470 configured to support the first pawl axle 448 of the first pawl 406. The lid 410 may also each include an elongate channel 472 that cooperates with the elongate channel 432 of the housing 400 to allow the anchor post 458 of the first pawl 406 to freely rotate relative to the housing 400 and the lid 410 when the first pawl 406 pivots about the first pawl axis of rotation $A_{FP}$ in either the first direction $D_{FP1}$ or the second direction $D_{FP2}$.

In use, the article of footwear 10 can be selectively moved between a tightened state and a relaxed state using the tensioning system 300. With the footwear 10 initially provided in a relaxed state, an effective length of the first cable 304 will be maximized, such that the first cable is in a relaxed state about the upper 100, while an effective length of the second cable 306 is minimized as the second cable 306 is wound about the spool 404 of the cable lock 302. Accordingly, a foot of a user can be inserted into the interior void 102 of the footwear 10, whereby the materials of the upper 100 allow the upper 100 to stretch to accommodate the foot therein.

With the foot of the user inserted within the interior void 102 of the upper 100, the tensioning system 300 can be moved to a tightened state by the user to secure the footwear 10 to the foot. As discussed above, the tensioning system 300 is moved to the tightened state by applying a tightening force $F_T$ to the tightening grip 388, thereby causing the second cable 306 to move in the tightening direction $D_T$. As the second cable 306 moves in the tightening direction $D_T$, the spool 404 rotates in the first direction $D_{S1}$ and the second cable 306 is unwound from the second channel 438. Simultaneously, the first cable 304 is wound up within the first channel 436, thereby causing the first cable 304 to be retracted within the cable lock 302. Accordingly, an effective length of the first cable 304 is minimized around the upper 100 to move the upper 100 to a tightened state around the foot.

As discussed above, when the first cable 304 is moved in the tightening direction $D_T$, the segments 316*a*-316*e* of the first section 308 distribute the tightening force $F_T$ to the ends 322, 338 of the first strap 320 and the second strap 334 to draw the first strap 320 and the second strap 334 tight over the tongue portion 106. Simultaneously, the segments 318*a*-318*e* of the second section 310 distribute the tightening force $F_T$ to the second end 324 of the first strap 320, the cable guides 358, 368 of the medial and lateral flaps 342, 362, and the anchor point 360 of the medial flap 342 to constrict a lower region of the tongue portion 106. Simultaneously, the effective length of the second cable 306 may be increased when the tensioning system 300 is moved to the tightened state. However, the second cable 306 may be maintained in a tightened position against the upper 100 by the elasticity of the sheath 386.

Prior to, during, or after movement of the tensioning system 300 to the tightened state, the biasing force of the first pawl spring 450 may move the first pawl 406 to the locked position when the release force $F_R$ applied to the release cord 390 is overcome by the first pawl spring 450. When the cable lock 302 is in the locked state, the teeth 444 of the spool 404 are engaged by the teeth 445 of the first pawl 406 to prevent the spool 404 from rotating in the second direction $D_{S2}$ (i.e., the loosening direction $D_L$). Accordingly, the cable lock 302 maintains the tensioning system 300 in the tightened state as long as the cable lock 302 remains in the locked position.

When a user desires to remove the article of footwear 10 from the foot, the tensioning system 300 may be moved to the loosed state to allow the upper 100 to be relaxed around the foot. Initially, the cable lock 302 must be moved to the unlocked state by applying a sufficient release force $F_R$ to overcome the biasing force of the first pawl spring 450. When the release force $F_R$ overcomes the biasing force, the teeth 445 of the first pawl 406 will disengage from the teeth 444 of the spool 404, thereby allowing the spool 404 to rotate in the second direction $D_{S2}$.

A loosening force $F_L$ may be applied to the first cable 304 by the user to move the first cable in the loosening direction $D_L$, thereby maximizing the effective length of the first cable 304 to allow the upper 100 to be relaxed. In the illustrated example, the loosening force $F_L$ may be applied indirectly to the first cable 304 by pulling the anterior end 18 of the upper 100 in a downward direction, whereby the interior void 102 is forced open to remove the foot. Alternatively, the first cable 304 may be provided with one or more loosening grips (not shown) to allow the user to apply the loosening force $F_T$ directly to the first cable 304.

As the first cable 304 moves in the loosening direction $D_L$, the spool 404 rotates in the second direction $D_{S2}$, whereby the first cable 304 is unwound from the first channel 436. As the first cable 304 is unwound, the effective length of the first cable 304 increases and the segments **316*a*-316*e*, 318*a*-318*f* of the first and second sections 308, 310 are relaxed, allowing the first strap 320, the second strap 334, the medial flap 342, and the lateral flap 362 to relax about the upper 100. Simultaneously, the second cable 306 is wound up within the second channel 438, thereby causing the second cable 306 to be retracted within the cable lock 302. Accordingly, an effective length of the second cable 306** is minimized.

The following Clauses provide exemplary configurations for an article of footwear and a cable lock in accordance with the principles of the present disclosure.

Clause 1: An article of footwear comprising: an upper defining an interior void; a sole structure attached to the upper and having a top surface facing toward the interior void and a ground-engaging bottom surface formed on an opposite side of the sole structure from the top surface; a cable lock disposed within the sole structure adjacent to the bottom surface; a first cable having a first section extending from the cable lock to a first anchor point on the upper and a second section extending from the cable lock to a second anchor point on the upper; and a second cable having a first section extending from the cable lock to a grip and a second section extending from the cable lock to the grip, the cable lock being operable to retract the first section and the second section of the first cable when the first section and the second section of the second cable are extended.

Clause 2: The article of footwear of Clause 1, wherein the cable lock is exposed to view through a viewing port disposed at the bottom surface of the sole structure.

Clause 3: The article of footwear of Clause 2, wherein the viewing port comprises an aperture extending at least partially through at least one of an outsole portion and a midsole portion of the sole structure.

Clause 4: The article of footwear of Clause 3, wherein the viewing port includes a window comprising a transparent barrier extending across the aperture.

Clause 5: The article of footwear of any of the preceding clauses, further comprising a first strap extending from a first end on a medial side of the upper to a second end on a lateral side of the upper, the first end of the first strap receiving the first section of the first cable and the second end of the first strap receiving the second section of the first cable.

Clause 6: The article of footwear of Clause 5, further comprising a second strap extending from a first end at a bite line of the footwear on the lateral side to a second end on the medial side of the upper, the second end defining a loop and receiving the first section of the first cable.

Clause 7: The article of footwear of any of the preceding clauses, wherein the cable lock includes a spool, the first cable being wound in a first direction around the spool and the second cable being wound in a second direction around the spool, the second direction being opposite the first direction.

Clause 8: The article of footwear of any of the preceding clauses, wherein the first section of the first cable includes a first plurality of segments extending along a medial side of the upper to the first anchor point on the medial side of the upper, and the second section of the first cable includes a second plurality of segments extending between a lateral side of the upper and the medial side of the upper to the second anchor point on the medial side of the upper.

Clause 9: The article of footwear of any of the preceding clauses, wherein the first anchor point is disposed on a medial side of the upper in a midfoot region adjacent to a bite line of the upper and the sole structure, and the second anchor point is disposed at a distal end of a flap disposed on the medial side of the upper in a forefoot region.

Clause 10: The article of footwear of Clause 9, wherein the flap extends from a proximal end attached at the bite line to the distal end adjacent to an instep region of the upper.

Clause 11: The article of footwear of Clause 9 or Clause 10, wherein the flap further includes a loop for receiving the second section of the first cable, the loop receiving a first segment and a second segment of the second section, and the second anchor point receiving a third segment of the second section.

Clause 12: The article of footwear of any of the preceding clauses, wherein internal components of the cable lock are visible through the bottom surface of the sole structure.

Clause 13: An article of footwear comprising: an upper defining an interior void, a sole structure attached to the upper and having a top surface facing toward the interior void and a ground-engaging bottom surface formed on an opposite side of the sole structure from the top surface; a cable lock disposed within the sole structure; a first cable having a first section extending in a first direction from the cable lock and a second section extending in a second direction from the cable lock, the first section including a first plurality of segments routed along a medial side of the upper through at least one strap and the second section including a second plurality of segments routed along a lateral side of the upper through the at least one strap; and a second cable extending from the cable lock and operable to move the first cable toward a retracted state when a tensile force applied to the second cable causes the second cable to pay out from the cable lock.

Clause 14: The article of footwear of Clause 13, wherein the cable lock is exposed to view through the bottom surface of the sole structure.

Clause 15: The article of footwear of Clause 14, wherein the cable lock is exposed to view through the bottom surface of the sole structure at an aperture extending at least partially through at least one of an outsole portion and a midsole portion of the sole structure.

Clause 16: The article of footwear of Clause 15, further comprising a window including a transparent barrier extending across the aperture.

Clause 17: The article of footwear of any of the preceding clauses, wherein the at least one strap includes a first strap extending from a first end disposed on a medial side of the upper to a second end disposed on the lateral side of the upper, the first end of the first strap receiving the first section of the first cable and the second end of the first strap receiving the second section of the first cable.

Clause 18: The article of footwear of Clause 17, wherein the at least one strap includes a second strap extending from a first end attached to the lateral side the footwear on the lateral side to a second end on the medial side of the upper, the second end defining a loop and a receiving the first section of the first cable.

Clause 19: The article of footwear of any of the preceding clauses, wherein the cable lock includes a spool, the first cable being wound in a first direction around the spool and the second cable being wound in a second direction around the spool, the second direction being opposite the first direction.

Clause 20: The article of footwear of any of the preceding clauses, wherein the first section of the first cable extends to a first anchor point on the medial side of the upper and the second section of the first cable extends a second anchor point on the medial side of the upper.

Clause 21: The article of footwear of Clause 20, wherein the first anchor point is disposed on a medial side of the upper in a midfoot region adjacent to a bite line of the upper and the sole structure and the second anchor point is disposed at a distal end of a flap disposed on the medial side of the upper in a forefoot region.

Clause 22: The article of footwear of Clause 21, wherein the flap extends from a proximal end attached at the bite line to the distal end adjacent to an instep region of the upper.

Clause 23: The article of footwear of Clause 21 or Clause 22, wherein the flap includes a loop for receiving the second section of the first cable, the loop receiving a first segment and a second segment of the second section, and the second anchor point receiving a third segment of the second section.

Clause 24: The article of footwear of any of the preceding clauses, wherein internal components of the cable lock are visible through the bottom surface of the sole structure.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. An article of footwear comprising:

an upper defining an interior void;

a sole structure attached to the upper and having a top surface facing toward the interior void and a ground-engaging bottom surface formed on an opposite side of the sole structure from the top surface;

a cable lock disposed within the sole structure adjacent to the bottom surface;

a first cable having a first section extending from the cable lock to a first anchor point on the upper and a second section extending from the cable lock to a second anchor point on the upper;

a second cable having a first section extending from the cable lock to a grip and a second section extending from the cable lock to the grip, the cable lock being operable to retract the first section and the second section of the first cable when the first section and the second section of the second cable are extended; and a first strap extending from a first end on a medial side of the upper to a second end on a lateral side of the upper, the first end of the first strap attached to the first section of the first cable and the second end of the first strap attached to the second section of the first cable.

2. The article of footwear of claim 1, wherein the cable lock is exposed to view through a viewing port disposed at the bottom surface of the sole structure.

3. The article of footwear of claim 2, wherein the viewing port comprises an aperture extending at least partially through at least one of an outsole portion and a midsole portion of the sole structure.

4. The article of footwear of claim 3, wherein the viewing port includes a window comprising a transparent barrier extending across the aperture.

5. The article of footwear of claim 1, wherein the first end of the first strap includes a first loop receiving the first section of the first cable and the second end of the first strap includes a second loop receiving the second section of the first cable.

6. The article of footwear of claim 5, further comprising a second strap extending from a first end at a bite line of the footwear on the lateral side to a second end on the medial side of the upper, the second end defining a third loop and receiving the first section of the first cable.

7. The article of footwear of claim 1, wherein the cable lock includes a spool, the first cable being wound in a first direction around the spool and the second cable being wound in a second direction around the spool, the second direction being opposite the first direction.

8. The article of footwear of claim 1, wherein the first section of the first cable includes a first plurality of segments extending along a medial side of the upper to the first anchor point on the medial side of the upper, and the second section of the first cable includes a second plurality of segments extending between a lateral side of the upper and the medial side of the upper to the second anchor point on the medial side of the upper.

9. The article of footwear of claim 1, wherein the first anchor point is disposed on a medial side of the upper in a midfoot region adjacent to a bite line of the upper and the sole structure, and the second anchor point is disposed at a distal end of a flap disposed on the medial side of the upper in a forefoot region.

10. The article of footwear of claim 9, wherein the flap extends from a proximal end attached at the bite line to the distal end adjacent to an instep region of the upper.

11. The article of footwear of claim 9, wherein the flap further includes a loop for receiving the second section of the first cable, the loop receiving a first segment and a second segment of the second section, and the second anchor point receiving a third segment of the second section.

12. The article of footwear of claim 1, wherein internal components of the cable lock are visible through the bottom surface of the sole structure.

13. An article of footwear comprising:

an upper defining an interior void;

a sole structure attached to the upper and having a top surface facing toward the interior void and a ground-engaging bottom surface formed on an opposite side of the sole structure from the top surface;

a cable lock disposed within the sole structure;

a first strap extending from a first end on a medial side of the upper to a second end on a lateral side of the upper;

a first cable having a first section extending in a first direction from the cable lock and a second section extending in a second direction from the cable lock, the first section including a first plurality of segments routed along a medial side of the upper and attached to the first end of the first strap and the second section including a second plurality of segments routed along a lateral side of the upper and attached to the second end of the first strap; and a second cable extending from the cable lock and operable to move the first cable toward a retracted state when a tensile force applied to the second cable causes the second cable to pay out from the cable lock.

14. The article of footwear of claim 13, wherein the cable lock is exposed to view through the bottom surface of the sole structure.

15. The article of footwear of claim 14, wherein the cable lock is exposed to view through the bottom surface of the sole structure at an aperture extending at least partially through at least one of an outsole portion and a midsole portion of the sole structure.

16. The article of footwear of claim 15, further comprising a window including a transparent barrier extending across the aperture.

17. The article of footwear of claim 13, wherein the first end of the first strap includes a first loop receiving the first section of the first cable and the second end of the first strap includes a second loop receiving the second section of the first cable.

18. The article of footwear of claim 13, further comprising a second strap extending from a first end attached to the lateral side of the footwear on the lateral side to a second end on the medial side of the upper, the second end defining a third loop and a receiving the first section of the first cable.

19. The article of footwear of claim 13, wherein the cable lock includes a spool, the first cable being wound in a first direction around the spool and the second cable being wound in a second direction around the spool, the second direction being opposite the first direction.

20. The article of footwear of claim 13, wherein the first section of the first cable extends to a first anchor point on the medial side of the upper and the second section of the first cable extends to a second anchor point on the medial side of the upper.

21. The article of footwear of claim 20, wherein the first anchor point is disposed on a medial side of the upper in a midfoot region adjacent to a bite line of the upper and the sole structure and the second anchor point is disposed at a distal end of a flap disposed on the medial side of the upper in a forefoot region.

22. The article of footwear of claim 21, wherein the flap extends from a proximal end attached at the bite line to the distal end adjacent to an instep region of the upper.

23. The article of footwear of claim 21, wherein the flap includes a loop for receiving the second section of the first cable, the loop receiving a first segment and a second segment of the second section, and the second anchor point receiving a third segment of the second section.

24. The article of footwear of claim 13, wherein internal components of the cable lock are visible through the bottom surface of the sole structure.

* * * * *